US009554662B2

(12) United States Patent
Law et al.

(10) Patent No.: US 9,554,662 B2
(45) Date of Patent: Jan. 31, 2017

(54) NECK PILLOW

(71) Applicant: MAGMATIC LIMITED, Bristol (GB)

(72) Inventors: Robert Law, Bristol (GB); Alice Ives, Bristol (GB); Sarah Perks, Bristol (GB); Joe Allam, Bristol (GB)

(73) Assignee: MAGMATIC LIMITED, Bristol (GB)

( * ) Notice: Subject to any disclaimer, the term of this patent is extended or adjusted under 35 U.S.C. 154(b) by 0 days.

(21) Appl. No.: 14/909,805

(22) PCT Filed: Jul. 16, 2014

(86) PCT No.: PCT/GB2014/052167

§ 371 (c)(1),
(2) Date: Feb. 3, 2016

(87) PCT Pub. No.: WO2015/019048

PCT Pub. Date: Feb. 12, 2015

(65) Prior Publication Data

US 2016/0192795 A1 Jul. 7, 2016

(30) Foreign Application Priority Data

Aug. 6, 2013 (GB) ..... 1314045.4

(51) Int. Cl.

| | |
|---|---|
| ***A47G 9/10*** | (2006.01) |
| ***A47C 31/00*** | (2006.01) |
| ***A47C 7/38*** | (2006.01) |

(52) U.S. Cl.
CPC ..... *A47G 9/1081* (2013.01); *A47C 7/383* (2013.01); *A47C 31/003* (2013.01)

(58) Field of Classification Search
CPC ..... A47G 9/10
USPC ..... 5/630, 636–637, 639–640, 643
See application file for complete search history.

(56) References Cited

U.S. PATENT DOCUMENTS

| | | | | |
|---|---|---|---|---|
| 4,617,691 | A | 10/1986 | Monti et al. | |
| D419,267 | S * | 1/2000 | Hartunian | D24/191 |
| 6,266,832 | B1 * | 7/2001 | Ezell | A47G 9/10 297/219.12 |
| D469,541 | S * | 1/2003 | Cheatham | D24/191 |
| 6,641,221 | B1 | 11/2003 | Kastlunger | |
| 2002/0043859 | A1 | 4/2002 | Smith | |

FOREIGN PATENT DOCUMENTS

| | | |
|---|---|---|
| GB | 2 405 088 A | 2/2005 |
| WO | 2013 084005 A1 | 6/2013 |

* cited by examiner

*Primary Examiner* — Fredrick Conley
(74) *Attorney, Agent, or Firm* — Mossman Kumar & Tyler PC

(57) ABSTRACT

The present invention provides a neck pillow comprising an elongate cushioned member extending from a first end to a second end of the pillow. Each end comprises at least one fastening element for mutual engagement such that the pillow may be arranged in a closed configuration in which the pillow defines a closed loop and an open configuration in which the ends are spaced apart from each other.

5 Claims, 4 Drawing Sheets

NECK PILLOW

BACKGROUND TO THE INVENTION

The present invention relates to a pillow, in particular to a neck pillow, to provide support to a user. In particular, the present invention relates to a neck pillow to provide support for the neck in particular the chin. The present invention relates to a neck pillow for children for use during travel, such as for example in a car or on a plane.

SUMMARY OF THE INVENTION

While travelling in cars or on planes it is difficult for passengers, in particular, for children to sleep comfortably. This can result in the head and the neck of the passenger being placed in uncomfortable positions. A number of pillows exist to help to provide comfort in these situations. These pillows do not however provide support for a chin, as the pillows are often open in this area, providing side and back support but no front support. This is particularly a problem for children who's heads often fall forward while sleeping in an upright position. Such an upright position is often as a result of traveling in a seat, such as in a car, bus, train or plane.

The present invention seeks to address the problems of the prior art. In particular, the present invention seeks to provide a pillow, in particular a neck pillow, which will remain in position so as to provide the necessary support and/or comfort to the user, specifically the chin.

According to a first aspect of the present invention, there is provided a neck pillow comprising an elongate cushioned member extending from a first end to a second end of the pillow, each end comprising at least one fastening element for mutual engagement such that the pillow may be arranged in a closed configuration in which the pillow defines a closed loop and an open configuration in which the ends are spaced apart from each other.

The neck pillow of the present invention forms a closed loop when worn by the user, in particular by a child. The neck pillow may remain in a closed loop in the closed configuration during use. In the close configuration, the neck pillow preferably substantially surrounds the neck of a user. As a result, the neck pillow preferably provides a chin support region to keep the users head upright. If the pillow moves during use the pillow may simply rotate about the neck of the user. The pillow will however still be located adjacent the neck of the user, and preferably still provide a chin support region adjacent to the chin of the user, so as to provide the necessary support and/or comfort in the desired locations around the user's neck.

Preferably, the closed loop formed by the pillow in the closed configuration is substantially annular.

Each end of the neck pillow preferably provides an abutment surface. The abutment surface of one end is preferably arranged to engage the abutment surface of the other end of the pillow. The abutment surface is preferably substantially planar. In the closed configuration no gaps are provided between the ends of the pillow as the abutment surfaces are substantially planar. As a result, the pillow provides increased comfort and/or support in the region of the join between the ends of the pillow. The abutment surfaces and the adjacent regions of the neck pillow preferably provide a chin support region for supporting the chin of a user in use.

The neck pillow preferably further comprises at least one stiffening member located at or adjacent at least one end of the pillow. The at least one stiffening member is preferably arranged to ensure that the abutment surface provided by the adjacent end is substantially flat. The at least one stiffening member may be provided by at least a portion of, preferably the majority of, such as for example substantially all of the surface of the pillow.

The stiffening member may be formed of any suitable material. For example, the stiffening member may be composed of a stiff material. Examples of suitable stiff material include fabric, non-woven material, cardboard, rubber, plastic, or a combination thereof.

The fastening element(s) may comprise any suitable means for releasable engagement between the ends of the pillow. The fastening element(s) may comprise for example hooks, clips, buckles, magnets, Velcro or any combination thereof. Preferably, the fastening element(s) comprise at least one magnet. If the neck pillow is intended to be used by a child, the fastening elements are preferably magnets.

The fastening element(s) may be provided at any suitable location at or adjacent the end(s) of the pillow. The fastening element(s) are preferably provided at the ends of the pillow. For example, the fastening element(s), for example magnet (s), may be located centrally with respect to the end(s) of the pillow. The fastening element(s), for example magnet(s) may be offset from the centre of the end(s) of the pillow.

The pillow may comprise an inner surface arranged to be positioned in use adjacent the neck of a user, and an outer surface arranged to be positioned in use away from the neck of a user. The fastening element(s), for example magnet(s) may be offset from the centre of the end(s) of the pillow and positioned closer to the inner surface of the pillow than the outer surface of the pillow. This arrangement may help to minimise any gap between the ends of the pillow at the inner surface of the pillow in the closed configuration.

The neck pillow may comprise at least one magnet at one end of the pillow. The magnet(s) may be secured to an end or adjacent an end of the neck pillow by any suitable means. The other end of the pillow may comprise magnetic metal such as for example iron or steel.

Preferably, each end of the pillow comprises at least one magnet. The magnets are preferably arranged to be attracted to each other to ensure closure of the ends of the pillow.

The pillow may provide at least one pocket for retaining at least one magnet. At least one pocket may be provided at least one end or adjacent an end of the pillow. At least one magnet may be received within each pocket. Preferably, each end of the pillow provides a pocket. A secure pocket is preferable because should a magnet become assessable, specifically to a child, it could be consumed and cause death.

The or each pocket may be defined by two spaced apart walls providing a cavity therebetween for receiving at least one magnet. The or each pocket may provide or be located adjacent an abutment surface at one end of the pillow. For example, a wall of the pocket may provide the abutment surface at an end of the pillow. The or each pocket may be located adjacent at least one stiffening member. The at least one stiffening member may form part of the or each pocket.

The pocket may be formed from woven fabric material. The pocket may however be formed from rubber, plastic, cardboard, non-woven material.

The elongate cushioned member may have any suitable shape for providing support and/or comfort to a user. The elongate cushioned member may comprise an inner surface arranged in use to be positioned adjacent the neck of a user. Preferably, at least a portion of the inner surface of the elongate cushioned member is arcuate in shape. Preferably, the elongate cushioned member provides an arcuate inner surface extending between both ends of the member. The elongate cushioned member is preferably substantially circular or oval shape in cross-section.

The elongate cushioned member is preferably composed of a soft to touch material, possibly plush or other tactile materials.

BRIEF DESCRIPTION OF THE DRAWINGS

An embodiment of the invention will now be described, by way of example only, and with reference to the accompanying drawings, in which.

DETAILED DESCRIPTION OF THE INVENTION

Figure 1A:
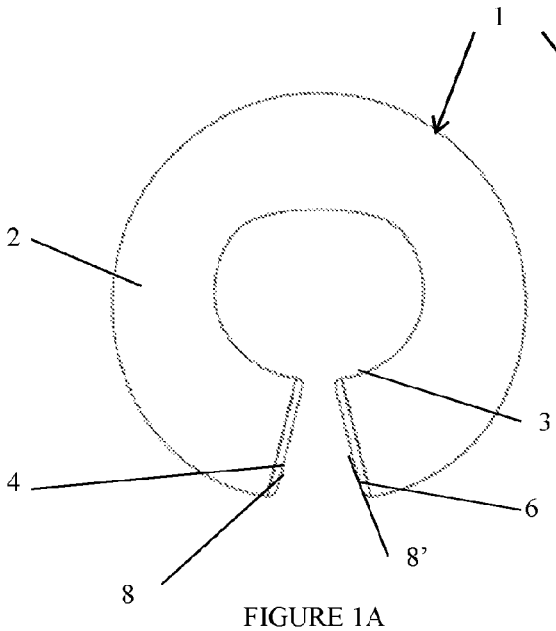
FIGS. 1A and 1B illustrate views from above of one embodiment of the neck pillow of the present invention in the open configuration (FIG. 1A) and in the closed configuration (FIG. 1B) respectively.

The neck pillow 1 comprises an elongate cushioned member 2 extending between a first end 4 and a second end 6 of the pillow 1. The elongate cushioned member 2 provides an arcuate surface on the inner surface 3 which is arranged in use to be located adjacent the neck of the user. The elongate cushioned member 2 has a substantially oval cross-section. It is however to be understood that the elongate cushioned member 2 may have any suitable shape.

The neck pillow 1 is moveable between an open position in which ends 4,6 are spaced apart from each other (FIG. 1B), and a closed position in which the ends 4,6 are in contact with each other such that pillow 1 forms a closed loop (FIG. 1A). In the closed configuration the closed loop is substantially annular. The pillow 1 is arranged to extend around the neck of a user, in particular a child.

Figure 6:
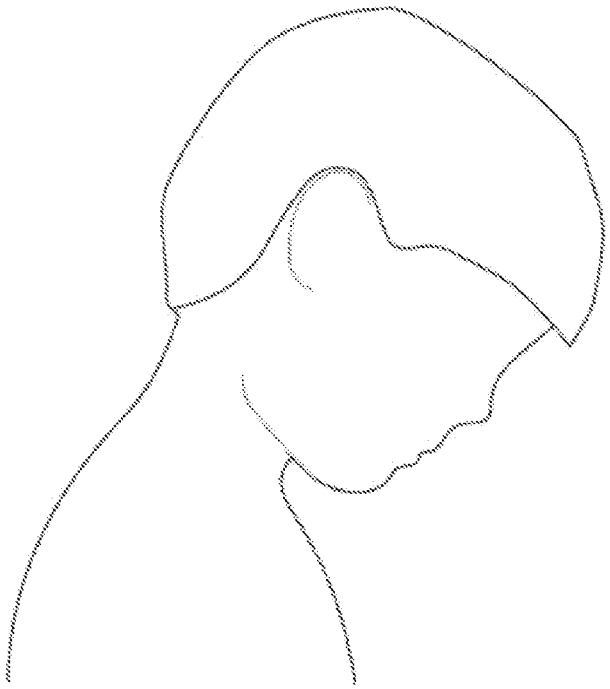
FIG. 6 illustrates a side view of a child in a sleeping position when sat in a vehicle.
Figure 7:
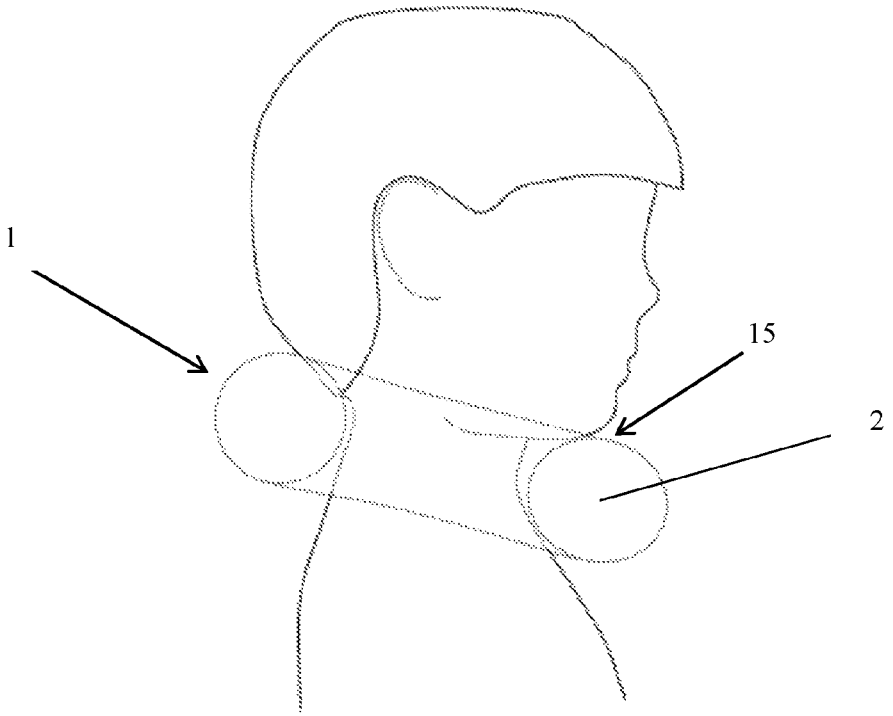
FIG. 7 illustrates a side view of a child in a sleeping position whilst wearing a neck pillow of FIGS. 1A-C when sat in a vehicle.

While travelling in cars or on planes it is difficult for passengers, in particular, for children to sleep comfortably. This can result in the head and the neck of the passenger being placed in uncomfortable positions. As shown in FIG. 6, this is particularly a problem for children who's heads often fall forward while sleeping in an upright position. FIG. 7 shows that in the closed position, the pillow 1 is arranged to substantially surround the neck of a user and provide a chin support region 15 for supporting the chin of a user in use.

Each end 4,6 of the neck pillow 1 provides an abutment surface 8,8'. The abutment surfaces 8,8' are substantially planar. The substantially planar abutment surfaces 8,8' of the pillow 1 ensure good contact is formed between the ends 4,6 in the closed position. As a result, any gaps between the ends 4,6, particularly at the inner surface 3, of the pillow 1 are minimised. It is however to be appreciated that the abutment surfaces 8,8' may be of any suitable shape.

A pocket 10,10' is provided at each end 4,6 of the neck pillow 1. Each pocket 10,10' is located adjacent the abutment surface 8,8' at each end 4,6 of the neck pillow 1.

The pockets 10,10' are formed from woven fabric material, but could also be made from rubber, plastic, cardboard, none woven material The neck pillow 1 further comprises a stiffening member 12,12' located adjacent the abutment surfaces 8,8' at each end 4,6 of the pillow 1. The stiffening members 12,12' are arranged to ensure that the abutment surfaces 8,8' provided by each end 4,6 are substantially flat. Each pocket 10,10' is located adjacent a stiffening member 12,12'.

The stiffening members 12,12' are formed from stiff material, such as for example fabric, none woven material, cardboard, rubber, plastic, or a combination thereof.

Figure 5:
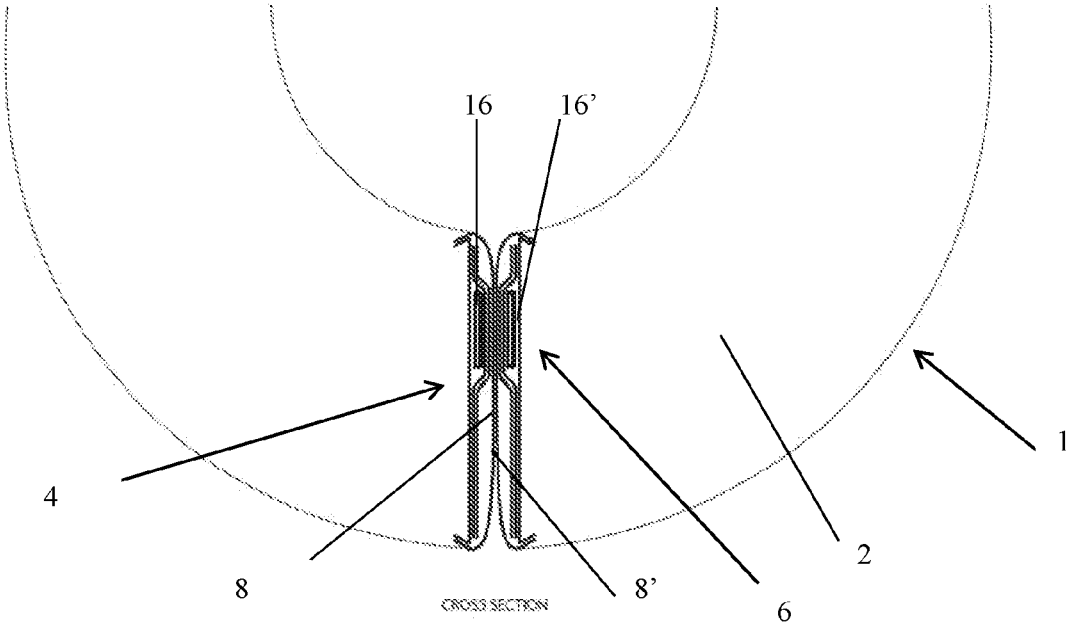
FIG. 5 illustrates a schematic view of the ends of the neck pillow of FIG. 1B in the closed configuration.

Each pocket 10,10' comprises a pair of spaced apart walls 11,13 providing a cavity 14 therebetween. The cavity 14 is offset from the centre of the ends 4,6 of the pillow 1. Each pocket 10,10' is arranged to receive a magnet 16,16'. The pockets 10,10' are aligned at each end 4,6 of the pillow so that the magnets 16,16' are aligned in the closed configuration (FIG. 5).

As shown in FIGS. 2, 3, 4A and 4B, each end 10 comprises a woven fabric pocket 12 providing a cavity 14 for a magnet 16. The pocket 10 is covered with a stiffening member 12 to provide the abutment surface 8. The stiffening member 12 is then covered with an outer material, such as for example a fabric material.

Figure 1B:
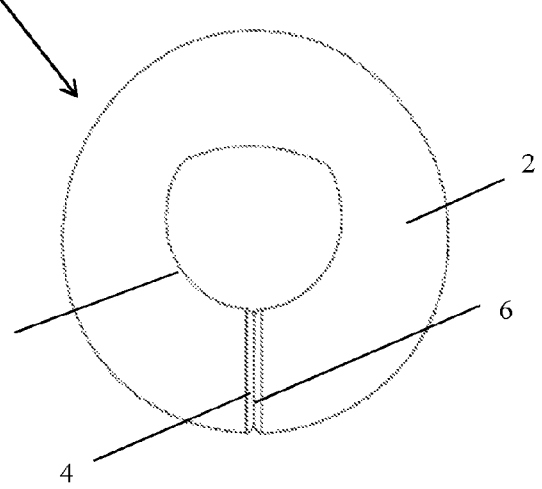
Figure 1C:
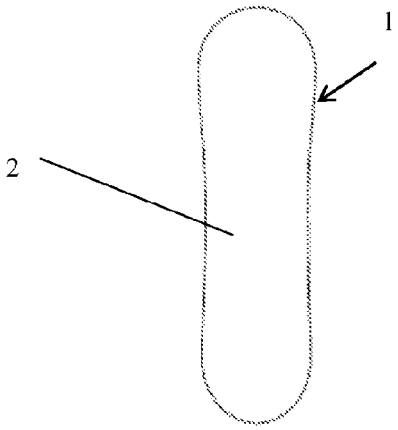
FIG. 1C illustrates a side view of the neck pillow of FIGS. 1A and 1B.
Figure 2:
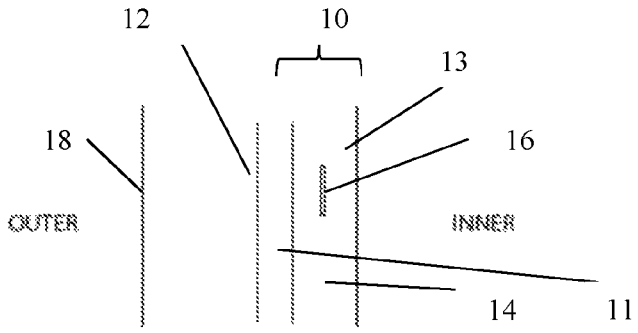
FIG. 2 illustrates a schematic cross-sectional view of an end of the neck pillow of FIGS. 1A and 1B.
Figure 3:
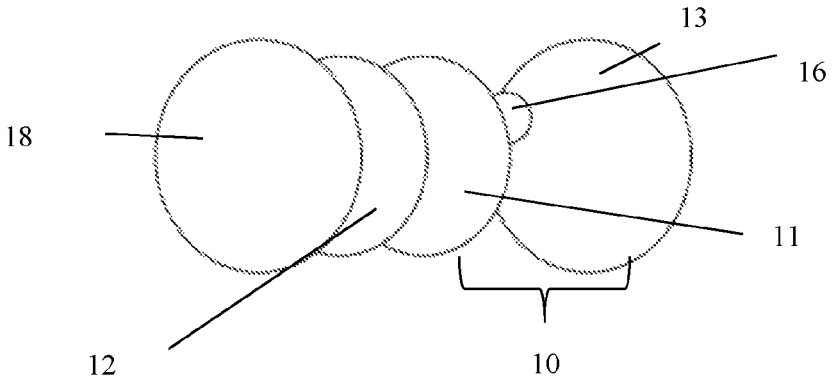
FIG. 3 illustrates an exploded view of an end of the neck pillow of FIGS. 1A and 1B.
Figure 4A:
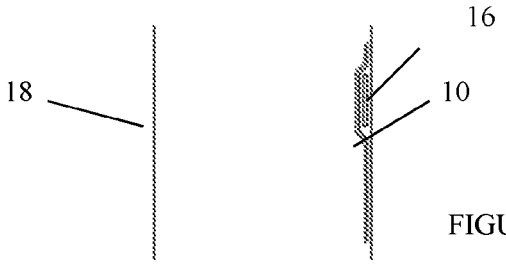
FIGS. 4A and 4B illustrates an exploded cross-sectional view and a schematic cross-sectional view of one end of the pillow of FIGS. 1A and 1B.
Figure 4B:
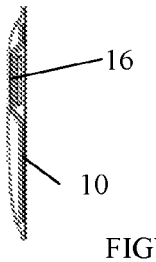

In use, the user, in particular a child, places the neck pillow 1 around their neck in the open configuration as shown in FIG. 1A. The ends 4,6 of the pillow 1 are brought together by the user into the closed configuration as shown in FIG. 1B. The magnetic attraction between the magnets in each end 4,6 retains the pillow 1 in a closed annular loop around the neck of the user. The stiffening members 12,12' ensure that the abutment surfaces 8,8' are substantially planar ensuring a smooth transition between the ends 4,6 of the pillow. The smooth transition between the ends 4,6 of the pillow ensures increased comfort and/or support for the user when resting on the join between the ends 4,6 of the pillow. The neck pillow 1 may move during use about the neck of the user. However, due to the shape of the pillow, in particular its annular configuration, the pillow may simply rotate about the neck of the user. The pillow 1 will however be able to provide the necessary comfort and/or support to a user during use regardless of its position about the neck of the user. As shown in FIG. 7, the pillow 1 provide support to the chin of a user, such as for example a child.

To remove the neck pillow, the user, in particular a child, simply pulls apart the ends 4,6 of the pillow with a force greater than the attraction between the magnets. As the neck pillow is retained in the closed configuration by magnets the neck pillow can be removed easily by a child. The neck pillow 1 does not require an unnecessary amount of force to undo the magnets so that a child can remove the pillow 1.

Although aspects of the invention have been described with reference to the embodiment shown in the accompanying drawings, it is to be understood that the invention is not limited to the precise embodiment shown and that various changes and modifications may be effected without further inventive skill and effort.

The invention claimed is:

1. A neck pillow comprising an elongate cushioned member extending from a first end to a second end of the pillow, each end comprising a substantially planar abutment surface, a pocket adjacent the abutment surface, a magnet disposed in the pocket, the magnets being located for mutual releasable engagement such that the pillow has a closed configuration in which the pillow defines a substantially annular closed loop in which the respective substantially planar abutment surfaces of the first and second ends are adjacent one another and an open configuration in which the ends are spaced apart from each other, the pillow further comprising stiffening members located adjacent respective pockets at each end of the pillow, the stiffening members being arranged to ensure that the corresponding abutment surface is substantially flat.

2. A neck pillow as claimed in claim 1, in which the pillow comprises a chin support region.

3. A neck pillow as claimed in claim 1, in which the stiffening members form respective parts of the pockets.

4. A neck pillow as claimed in claim 1, wherein the stiffening member is composed of stiff material.

5. A neck pillow as claimed in claim 1, wherein the stiffening member is composed of stiff material selected from fabric, non-woven material, cardboard, rubber, plastic, or a combination thereof.

* * * * *